US007575227B2

(12) United States Patent
Suzuki et al.

(10) Patent No.: US 7,575,227 B2
(45) Date of Patent: Aug. 18, 2009

(54) SHEET PROCESSING APPARATUS AND IMAGE FORMING APPARATUS

(75) Inventors: Toshimasa Suzuki, Kashiwa (JP); Kenichi Hayashi, Abiko (JP); Atsuteru Oikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 337 days.

(21) Appl. No.: 11/509,024

(22) Filed: Aug. 24, 2006

(65) Prior Publication Data

US 2007/0045921 A1 Mar. 1, 2007

(30) Foreign Application Priority Data

Aug. 31, 2005 (JP) ..... 2005-252418

(51) Int. Cl.
*B65H 37/04* (2006.01)

(52) U.S. Cl. ..... 270/37; 270/32

(58) Field of Classification Search ..... 270/32, 270/37

See application file for complete search history.

(56) References Cited

U.S. PATENT DOCUMENTS

| | | | | |
|---|---|---|---|---|
| 6,022,011 | A * | 2/2000 | Hirose | 270/37 |
| 6,575,447 | B2 * | 6/2003 | Yoshie et al. | 270/58.07 |
| 7,165,764 | B2 | 1/2007 | Nakamura et al. | 270/58.11 |
| 7,192,020 | B2 | 3/2007 | Hayashi et al. | 270/58.11 |
| 2005/0179190 | A1 | 8/2005 | Kamiya et al. | 270/58.07 |
| 2006/0017209 | A1 | 1/2006 | Kushida et al. | 270/37 |
| 2006/0017218 | A1 | 1/2006 | Kawata et al. | 271/207 |
| 2006/0018694 | A1 | 1/2006 | Hayashi | 399/406 |
| 2006/0019811 | A1 | 1/2006 | Ikeda et al. | 493/444 |
| 2006/0027959 | A1 * | 2/2006 | Doi | 270/37 |
| 2006/0049570 | A1 | 3/2006 | Kobayashi | 270/58.09 |

FOREIGN PATENT DOCUMENTS

JP 2001-206626 7/2001

OTHER PUBLICATIONS

Official Letter/Search Report, issued by the European Patent Office, on May 20, 2008, in European Patent Application No. 06017807.6.

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

Provided is a sheet folding apparatus for folding a sheet stack, including a sheet stack support member for supporting a sheet stack by being abutted against a lower edge of the sheet stack, an abutting member for folding the sheet stack by making the sheet stack supported by the sheet stack support member abutted against a leading edge of the abutting member, and paired folding rollers for sandwiching the sheet stack folded by the abutting member to fold the sheet stack at a fold position, in which a position where the sheet stack is abutted against the leading edge of the abutting member with respect to the fold position is varied based on sheet stack information.

9 Claims, 9 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus. More particularly, the present invention relates to a structure for folding a sheet stack for bookbinding.

2. Description of the Related Art

Up to now, there are image forming apparatuses represented by a digital copying machine, and provided with scanning function for reading an image from a document and printing function for printing the scanned image on a sheet such as recording paper. Some of such the image forming apparatuses include a sheet processing apparatus for, after an image is formed, taking in a delivered sheet, stitching the sheet substantially around a center line of the sheet, folding the sheet or the like, and then delivering and stacking the sheet on a sheet stacking portion.

Such the sheet processing apparatuses include a saddle stitch bookbinding apparatus which saves space, is small, and is low-priced. In such the saddle stitch bookbinding apparatus, after stacking and aligning sheets which are transported one by one in a substantially perpendicular vertical intermediate stacking tray, a stapler saddle stitches the sheet at a center portion. After that, an abut plate and a folding roller fold the sheet at the center portion to conduct bookbinding.

Such the conventional saddle stitch bookbinding apparatus is provided with a leading edge regulating member for, when a sheet is brought in the intermediate stacking tray, aligning a sheet by being brought into contact with a leading edge of the sheet. It is to be noted that the leading edge regulating member is set to be in such a position as to stitch the sheet at the center portion in a direction of its transportation and in such a position as to fold the sheet at a stitch position according to the size of the sheet which is brought in.

It is to be noted that, some of such the apparatuses are structured such that, when the stitch position and the fold position are misaligned with the center portion due to variation in the size of the sheet, a user can adjust the height of the sheet when stitched and folded (see Japanese Patent Application Laid-open No. 2001-206626).

In such the conventional sheet processing apparatus (saddle stitch bookbinding apparatus), a fold process is conducted always by abutting the center portion of the sheet against the abut plate, irrespective of the size and thickness of the sheet and the number of sheets in the stack of the sheet. However, when the center portion of the sheet is abutted against the abut plate in this way, and in particular, when the intermediate stacking tray is disposed substantially perpendicularly, there is a problem that the fold position varies depending on a self weight and a solidity of the sheet and the fold position of the sheet is misaligned.

Next, a mechanism where the fold position is misaligned in this way is described with reference to FIG. 8.

FIG. 8A illustrates a state just before abutting and folding operation after a sheet S is brought in an intermediate stacking tray 412 disposed substantially perpendicularly, aligned and saddle stitched, and is then transported in a stack to a half-fold position where the lower edge of the sheet is brought into contact with a leading edge regulating member 411.

In this state, when a sheet stack Sa is abutted against an abut plate 418, in the case of the perpendicular intermediate stacking tray 412, the structure is constructed such that a lower edge of the sheet stack Sa is lifted by friction force between the abut plate 418 and the sheet S until a folded portion of the sheet stack Sa enters a nip between folding rollers 413.

FIG. 8B illustrates a state where the abutted sheet stack Sa consists of a small number of, for example, two sheets. By abutting a center portion of the sheet stack Sa in a direction of transportation against a leading edge of the abut plate 418, the lower edge of the sheet stack Sa is lifted from the leading edge regulating member 411. In this state, the folded portion of the sheet stack Sa is introduced into the nip between the folding rollers 413.

FIG. 8C illustrates a state where the abutted sheet stack Sa consists of a large number of, for example, twenty sheets. In this case, due to the self weight of the sheet stack Sa, it is not possible to make the sheet stack Sa lifted and enter the nip between the folding rollers 413 by the abut plate 418 alone. In this case, the result is that the sheet stack Sa is folded at a position higher than a center position of the sheet stack Sa.

As illustrated in FIG. 8D, when the shape of a path in the intermediate stacking tray 412 in a position higher than the fold position is curved in terms of the structure of the apparatus, contrarily to the above-mentioned case, due to a transportation resistance in the curved path, the sheet S can not go down when the sheet S is abutted against the abut plate 418. As a result, the sheet stack Sa is folded at a position lower than the center position of the sheet stack Sa.

It is to be noted that, since the influence of the curved path varies depending on body of the sheet S, i.e., the thickness and the size of the sheet S, the amount of misalignment depends on the thickness and the size of the sheet. Further, the misaligned fold position depending on the number of sheets in the sheet stack and the size and the thickness of the sheet is also influenced by coefficient of friction between the leading edge of the abut plate 418 (which is brought into contact with the sheet) and the sheet S, and thus, the surface state of the sheet (in other words, whether it has an image formed thereon or not) is also a factor of the misaligned fold position.

FIG. 9 illustrates a state of a brochure B with the misaligned fold position caused by the above-mentioned factors. Even if the saddle stitch position is in a normal position, if the fold position is misaligned by a distance L, misalignment of 2 L is caused at a front edge of the brochure B and degrades an appearance of the brochure B.

Conventionally, when misalignment is caused in the formed brochure B, a user measures the distance L and adjusts the saddle stitch position or the half-fold position. However, this includes waste of sheets. Further, such adjustment is necessary with regard to each kind of jobs, and is troublesome.

SUMMARY OF THE INVENTION

The present invention has been made in view of the foregoing situation, and an object of the present invention is to provide a sheet processing apparatus which binds a sheet stack into a good-looking book.

According to one aspect of the invention, it is provided with a sheet folding apparatus for folding a sheet stack includes: a sheet stack support member which supports a sheet stack by being abutted against a lower edge of the sheet stack; an abutting member which folds the sheet stack by making the sheet stack supported by the sheet stack support member abutted against a leading edge of the abutting member; paired folding rollers which sandwich the sheet stack folded by the abutting member to fold the sheet stack at a fold position; and a control portion which controls a relative position between the sheet stack support member and the abutting member to be changed based on sheet stack information so that a position where the sheet stack is abutted against the leading edge of the abutting member with respect to the fold position is varied for the purpose of folding the sheet stack at the fold position by the paired folding rollers.

According to another aspect of the invention, it is provided with a sheet folding apparatus for folding a sheet stack includes: a sheet stack support member which supports a sheet stack by being abutted against a lower edge of the sheet stack; an abutting member which folds the sheet stack by making the sheet stack supported by the sheet stack support member abutted against a leading edge of the abutting member; and paired folding rollers which sandwich the sheet stack folded by the abutting member to fold the sheet stack at a fold position, and in the image forming apparatus, a position where the sheet stack is abutted against the leading edge of the abutting member with respect to the fold position is varied based on sheet stack information.

According to still another aspect of the invention, it is provided with an image forming apparatus having sheet processing apparatus connected thereto. The sheet processing apparatus includes: a sheet stack support member which supports a sheet stack by being abutted against a lower edge of a sheet stack; an abutting member which folds the sheet stack by making the sheet stack supported by the sheet stack support member abutted against a leading edge of the abutting member; and paired folding rollers which sandwich the sheet stack folded by the abutting member to fold the sheet stack at a fold position, and the sheet processing apparatus being for folding the sheet stack supported by the sheet stack support member at the fold position. The image forming apparatus includes a control portion which controls a relative position between the sheet stack support member and the abutting member to be changed based on sheet stack information so that a position where the sheet stack is abutted against the leading edge of the abutting member with respect to the fold position is varied for the purpose of folding the sheet stack at the fold position by the paired folding rollers.

Further features of the present invention will become apparent from the following description of exemplary embodiments (with reference to the attached drawings).

DESCRIPTION OF THE EMBODIMENTS

A best mode for carrying out the present invention is hereinafter described in detail with reference to the drawings.

Figure 1:
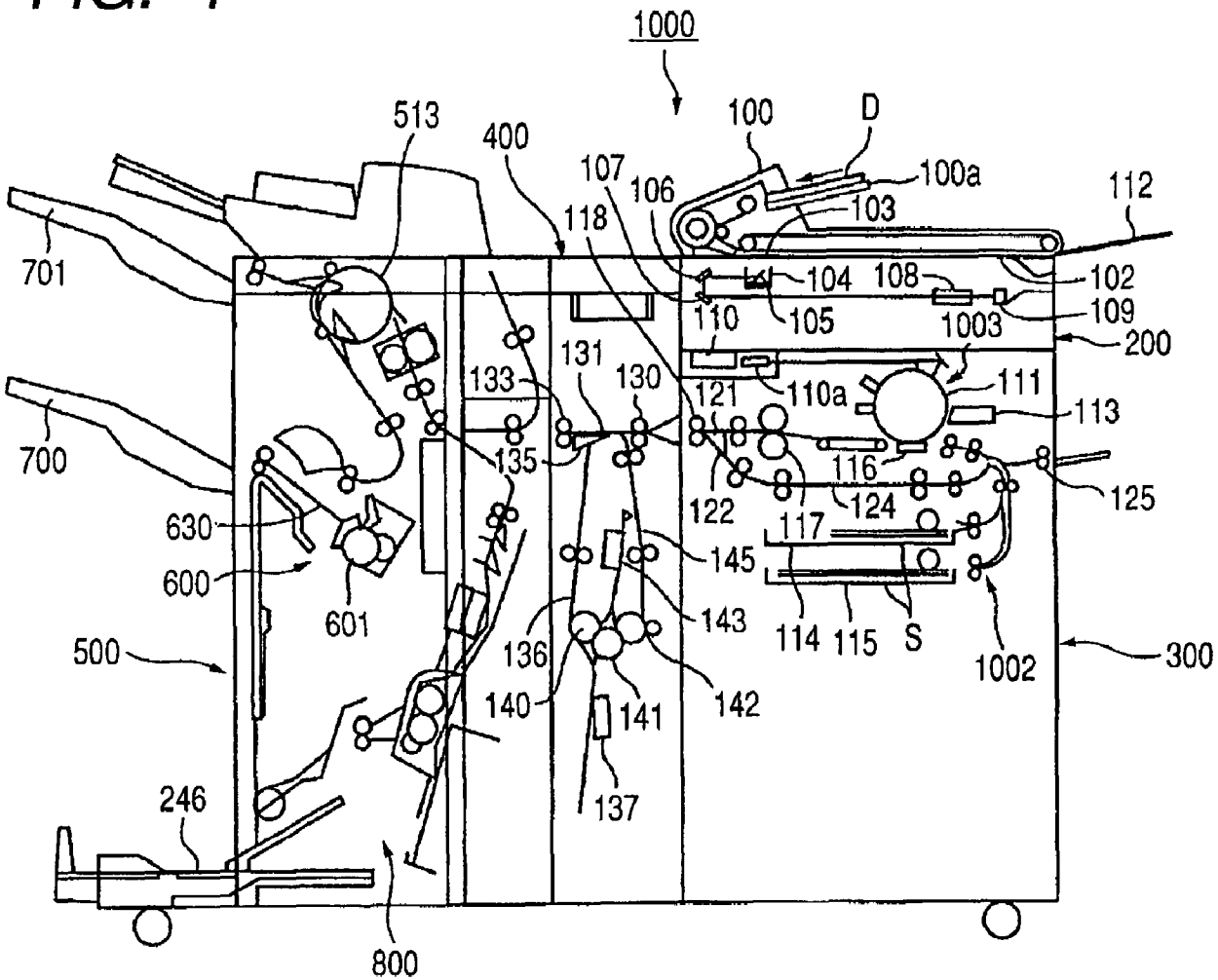
FIG. 1 is a sectional view of an image forming system according to an embodiment of the present invention.

FIG. 1 is a sectional view of an image forming system according to an embodiment of the present invention. The image forming system is formed of a sheet processing apparatus and a copying machine body as an exemplary image forming apparatus which is connected to the sheet processing apparatus.

In FIG. 1, a copying machine 1000 includes a copying machine body 300 and a scanner 200 disposed on an upper surface of the copying machine body 300.

The scanner 200 for reading a document includes a document feeding portion 100, a scanner unit 104, a lens 108, an image sensor 109, and the like. When the scanner 200 reads a document D, first, the document D is set on a tray 100*a* of the document feeding portion 100. It is to be noted that, at this point, the document D is set on the tray 100*a* in a faceup state, i.e., with its surface having an image formed thereon in an upward direction.

Next, the document D set in this way is transported by the document feeding portion 100 page by page in succession from a front page to the left (in the direction of an arrow in the figure). After that, the document D is transported from the left to the right on a platen glass 102 through a curved path, and then, the document D is delivered on a paper delivery tray 112.

Here, when the document is read while it is being fed, the scanner unit 104 is held in a predetermined position, and the document D is read by being made to pass above the scanner unit 104 from the left to the right.

In this reading processing, when the document D passes above the platen glass 102, the document D is irradiated with light from a lamp 103 of the scanner unit 104, and reflected light is introduced through mirrors 105, 106, and 107 and the lens 108 to the image sensor 109. It is to be noted that image data of the document read by the image sensor 109 is, after being subjected to predetermined image processing, sent to an exposure control portion 110.

On the other hand, when the document is read while it is in a fixed position, the document feeding portion 100 temporarily stops the transported document D on the platen glass 102. The document is read by moving the scanner unit 104 from the left to the right with this state maintained. When the document is read without using the document feeding portion 100, a user lifts the document feeding portion 100 and sets the document on the platen glass 102.

The copying machine body 300 includes a sheet feeding portion 1002 for feeding a sheet S housed in cassettes 114 and 115, an image forming portion 1003 for forming an image on the sheet S fed by the sheet feeding portion 1002, and the like.

The image forming portion 1003 includes a photosensitive drum 111, a developing unit 113, a transfer charger 116, and the like. When an image is formed, by irradiating the photosensitive drum with laser light from the exposure control portion 110, a latent image is formed on the photosensitive drum. After that, the latent image is visualized as a toner image by the developing unit 113. It is to be noted that a fixing device 117, paired delivery rollers 118, and the like are disposed downstream from the image forming portion 1003.

Next, image forming operation of the copying machine body 300 structured in this way is described.

First, as described above, when the scanner 200 scans the image while the document is being fed or while the document is in the fixed position, the image data of the document D read by the image sensor 109 is, after being subjected to predetermined image processing, sent to the exposure control portion 110. The exposure control portion 110 outputs laser light in accordance with the image signals.

The photosensitive drum 111 is irradiated with the laser light scanned by a polygon mirror 110*a*. An electrostatic latent image in accordance with the scanning laser light is formed on the photosensitive drum 111. Next, the electrostatic latent image formed on the photosensitive drum 111 is developed by the developing unit 113 and is visualized as a toner image.

Meanwhile, the sheet S is transported from either one of the cassette 114 or 115, a manual feed portion 125, and a duplex transportation path 124 to a transfer portion formed of the photosensitive drum 111 and the transfer charger 116. The toner image on the photosensitive drum is visualized by the transfer portion, and is transferred to the sheet S. The sheet S after the transfer undergoes fixing operation at a fixing portion 117.

Then, the sheet S which passed the fixing portion 117 is temporarily introduced to a path 122 by a flapper 121. After a trailing edge of the sheet comes out of the flapper 121, the sheet is switched back, transported by the flapper 121 to the delivery rollers 118, and delivered from the copying machine body 300. This makes it possible to deliver the sheet S from the copying machine body 300 with its surface having the toner image formed thereon in a downward direction (i.e., facedown).

It is to be noted that, when image forming operation is conducted page by page in succession from the front page by delivering the sheet S facedown using so-called turnover paper delivery, the order of the pages can be maintained by, for example, using the document feeding portion 100 to conduct the image forming operation. The order of the pages can also be maintained by conducting the image forming operation based on image data from a computer.

It is to be noted that, when image forming operation is conducted with respect to a rigid sheet S such as an OHP sheet which is transported from the manual feed portion 125, the sheet S is delivered without being introduced to the path 122. The sheet S is delivered by the delivery rollers 118 from the copying machine body 300 with its surface having the toner image formed thereon in an upward direction (i.e., faceup).

When image forming operation is conducted with regard to both surfaces of the sheet S, the sheet S is introduced straight toward the delivery rollers from the fixing portion 117. Immediately after the trailing edge of the sheet S comes out of the flapper 121, the sheet S is switched back, and is introduced by the flapper 121 to the duplex transportation path 124.

The copying machine body 300 includes a fold processing portion 400 for folding a sheet having an image formed thereon which is delivered from the copying machine body 300, and a finisher 500 which is a sheet processing apparatus for stitching and binding sheets.

Next, structures of the fold processing portion 400 and of the finisher 500 are described.

As illustrated in FIG. 1, the fold processing portion 400 includes a transportation path 131 for introducing a sheet delivered from the copying machine body 300 to a side of the finisher 500. Paired transport rollers 130 and 133 are provided on the transportation path 131. A switching flapper 135 is provided in proximity to the paired transport rollers 133. The switching flapper 135 is provided for the purpose of introducing a sheet transported by the paired transport rollers 130 to a folding path 136 or to the side of the finisher 500.

When the sheet S is to be folded, the switching flapper 135 is switched to the side of the folding path 136 so that the sheet is introduced to the folding path 136. After that, a leading edge of the sheet introduced to the folding path 136 is abutted against a stopper 137. A curve gradually formed by abutting the leading edge of the sheet against the stopper 137 is folded by folding rollers 140 and 141. Further, a curve formed by abutting the folded portion against an upper stopper 143 is folded by folding rollers 141 and 142 to Z-fold the sheet.

It is to be noted that the Z-folded sheet is sent to the transportation path 131 through a transportation path 145, and is delivered by transport rollers 133 to the finisher 500 on the downstream side. On the other hand, when the sheet S is not to be folded, the switching flapper 135 is switched to the side of the finisher so that the sheet delivered from the copying machine body 300 is directly sent to the finisher 500 through the transportation path 131.

The finisher 500 is provided for the purpose of taking in a sheet from the copying machine body 300 and aligning a plurality of sheets taken in to stack them as a sheet stack with or without sorting them. The finisher 500 also staples (i.e., stitches) the side of a trailing edge of a sheet stack, binding a sheet stack, and the like. The finisher 500 includes a staple portion 600 for stapling sheets and a saddle stitch portion 800 which is a binding processing portion for half-folding and binding a sheet stack.

Figure 2:
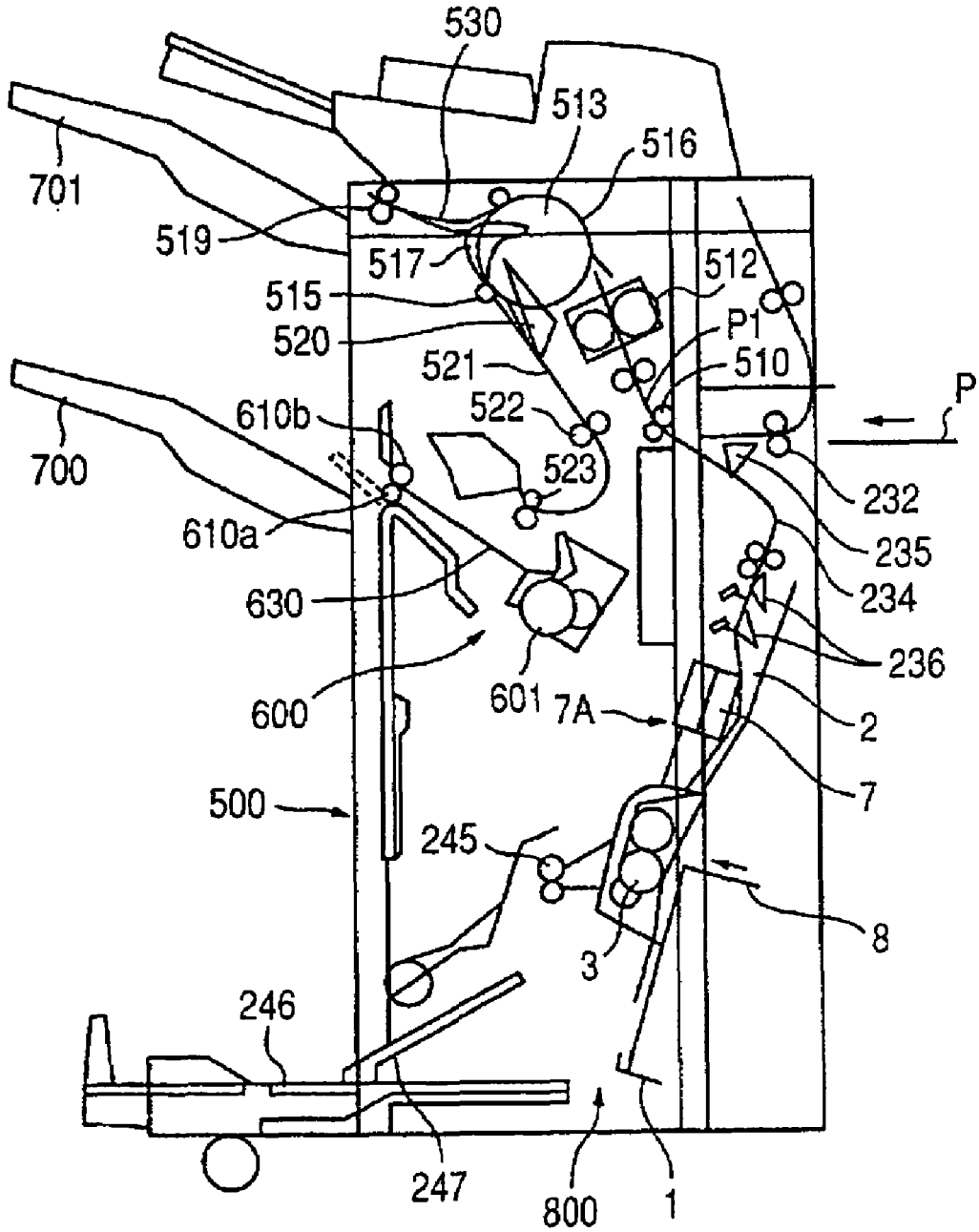
FIG. 2 is a sectional view of a finisher as a sheet processing apparatus of the image forming system.

As illustrated in FIG. 2, the finisher 500 includes paired inlet rollers 232 for taking a sheet transported through the fold processing portion 400 in the inside of the apparatus. Further, a switching flapper 235 for introducing a sheet to a finisher path P1 or to a lower bookbinding path 234 is provided downstream from the paired inlet rollers 232.

For example, when the sheet S is introduced by the switching flapper 235 to the finisher path P1, the sheet is transported toward a buffer roller 513 through paired transport rollers 510. It is to be noted that a punch unit 512 is provided between the paired transport rollers 510 and the buffer roller 513. By operating the punch unit 512 as needed, a hole is punched (i.e., perforated) near the trailing edge of the sheet which is transported through the paired transport rollers 510.

The buffer roller 513 is a roller around which a predetermined number of sheets transported through the transport rollers 510 can be wound. The sheets are wound around the buffer roller 513 by a hold-down roller 515 while the buffer roller 513 is rotated. This allows the sheet to be transported in a direction of rotation of the buffer roller 513.

A buffer path 516 is formed around the buffer roller 513. A switching flapper 517 is formed in the buffer path 516, and a switching flapper 520 is provided below the switching flapper 517.

The switching flapper 517 is provided for the purpose of separating the sheet wound around the buffer roller 513 from the buffer roller 513 to introduce the sheet to a non-sort path 530 on the side of a sample tray 701 or to a sort path 521. It is to be noted that the sheet introduced to the non-sort path 530 by the switching flapper 517 is delivered through the paired delivery rollers 519 to the sample tray 701.

The switching flapper 520 is provided for the purpose of separating the sheet wound around the buffer roller 513 from the buffer roller 513 to introduce the sheet to the sort path 521, or, for the purpose of introducing the sheet to the buffer path 516 with the sheet wound around the buffer roller 513.

The sheet introduced to the sort path 521 by the switching flapper 520 goes through paired transport rollers 522 and 523 to be stacked on a processing tray 630 as an intermediate tray. A group of sheets as a stack stacked on the processing tray 630 are, according to setting from an operation portion illustrated in FIG. 6 to be described later, aligned or stapled, and after that, delivered onto a stack tray 700 by delivery rollers 610*a* and 610*b*. It is to be noted that the stapling is conducted by a stapler 601 structured to be vertically self-propelled.

On the other hand, when the sheet is introduced to the bookbinding path 234 by the switching flapper 235, according to the size of the sheet, a flapper 236 selects an entrance for the sheet, and the sheet is brought in an intermediate stacking tray 2 as a sheet stacking portion of the saddle stitch portion 800.

The saddle stitch portion 800 includes the intermediate stacking tray 2 which is slanted or substantially perpendicular for housing a sheet stack Sa in an upright state. The saddle stitch portion 800 further includes a staple portion 7A which is provided in an upper end portion of the intermediate stacking tray 2 and which is formed of two pairs of staplers 7 and an anvil (not shown) for stitching the center of the sheet stack in cooperation with the staplers 7. The saddle stitch portion 800 further includes paired folding rollers 3 provided downstream from the staplers 7 and an abut plate 8 as an abutting member provided so as to be opposed to the paired folding rollers 3. The saddle stitch portion 800 further includes a movable leading edge regulating member 1 as a sheet stack support member which comes in contact with a leading edge (i.e., lower edge) of the sheet stack Sa for supporting the sheet stack and for regulating the position of the leading edge of the sheet stack.

It is to be noted that, as illustrated in FIG. 3, the abut plate 8 is adapted to protrude toward the sheet stack Sa housed in the intermediate stacking tray 2 by a link means 10 and a drive means 9. The leading edge regulating member 1 is fixed to a belt 11 which is driven by a drive means 12 such as a motor so as to be vertically moved by positive/negative rotation of the drive means 12 through the belt 11.

Next, bookbinding operation of the saddle stitch portion 800 structured as above is described.

First, a sheet brought in the intermediate stacking tray 2 of the saddle stitch portion 800 is transported until its leading edge is brought into contact with the leading edge regulating member 1 which is positioned in advance at a predetermined stitch position to be aligned in a width direction orthogonal to the direction of transportation. After that, in a case where binding processing is set, with this state maintained, the center of the sheet stack is stitched by the staple portion 7A.

Figure 3A:
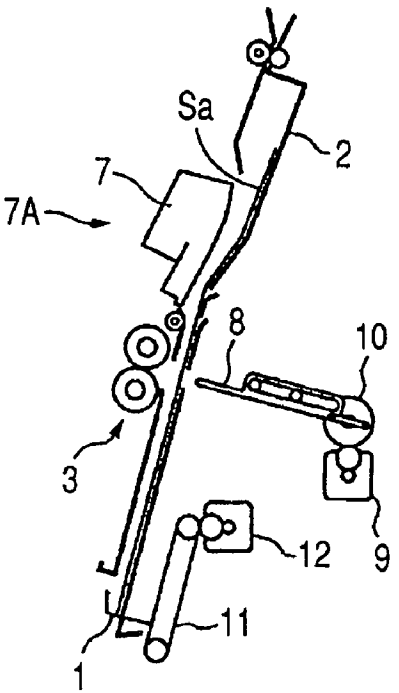
FIGS. 3A, 3B, 3C and 3D illustrate sheet stack folding operation of the finisher.

Then, the sheet stack with its center stitched by the staple portion 7A in this way is moved to a half-fold position since the leading edge regulating member 1 is lowered to a position illustrated in FIG. 3A by, for example, positive rotation of the drive means 12. It is to be noted that the saddle stitch portion 800 is provided with a leading edge home position sensor 13 for detecting the position of the leading edge regulating member 1. The leading edge home position sensor 13 is illustrated in FIG. 6 and is to be described later. The leading edge regulating member 1 is adapted to change the length of its movement from its home position based on a signal from the leading edge home position sensor 13 according to the size of the sheet. As a result, the leading edge regulating member 1 can be moved to a position where the center portion of the sheet can be saddle stitched and the sheet can be half-folded at the center portion.

Figure 3B:
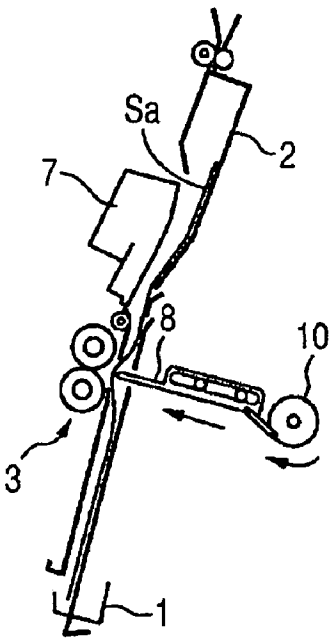
Figure 3C:
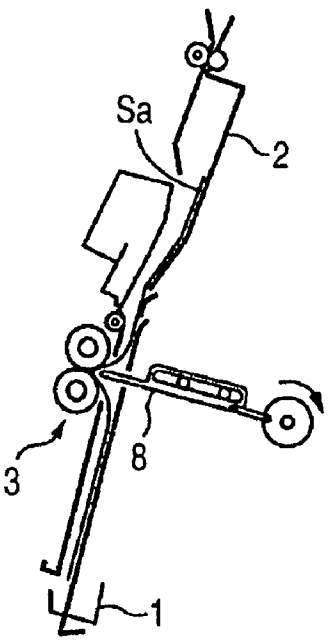
Figure 3D:
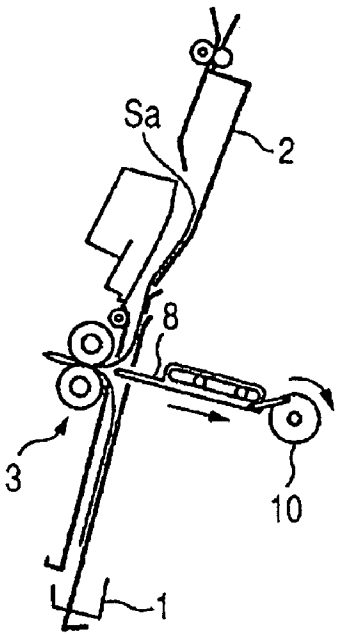

Then, with this state maintained, the abut plate 8 is made to protrude toward the sheet stack Sa housed in the intermediate stacking tray 2 by the link means 10 and the drive means 9 as illustrated in FIG. 3B. Then, as illustrated in FIG. 3C, the abut plate 8 is forced into a nip between the paired folding rollers 3. This can allow the sheet stack Sa to be folded by the paired folding rollers 3 as illustrated in FIG. 3D.

It is to be noted that, after the sheet stack Sa is folded, the abut plate 8 is moved away from the paired folding rollers 3 by the link means 10. The sheet stack Sa folded in this way is delivered to a delivery tray 246 through the paired folding rollers 3 and paper delivery rollers 245 illustrated in FIG. 2 with being guided by a guide plate 247.

Figure 4B:
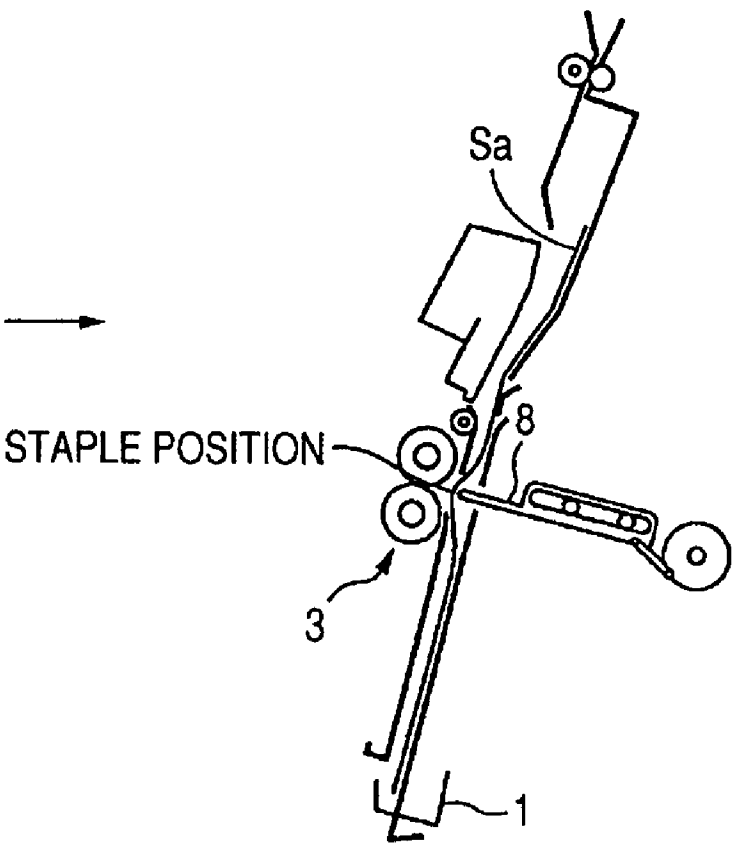
FIGS. 4A and 4B illustrate operation of folding a light sheet stack of the finisher.
Figure 4A:
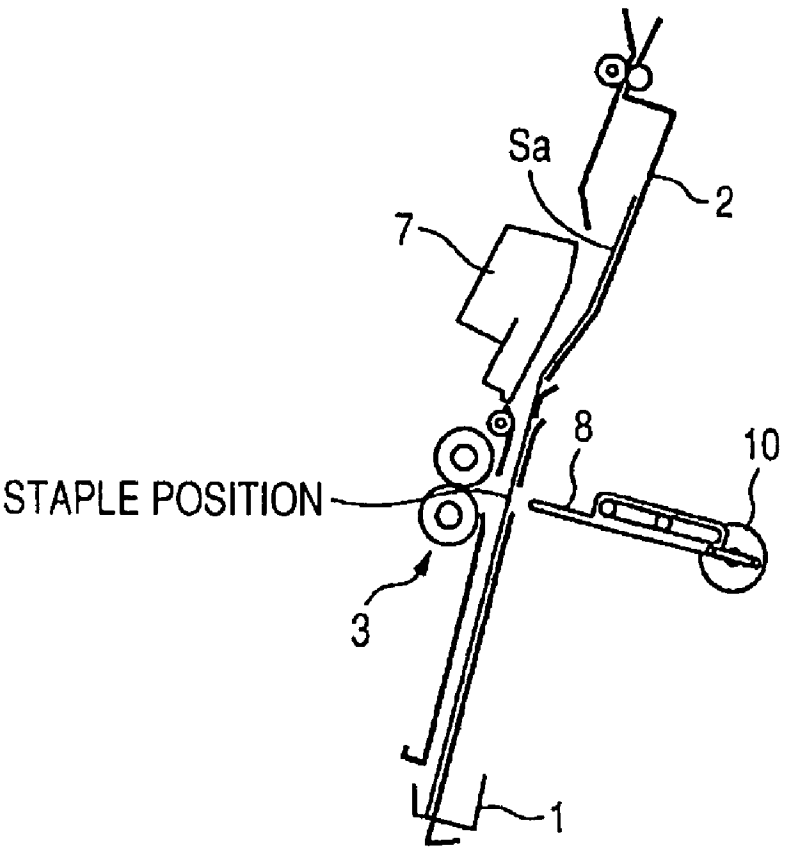

FIG. 4A illustrates a fold set position of the sheet stack Sa when its sheets are of ordinary thickness (for example, 80 g/m$^2$ paper) and the number of the sheets in the stack is small (for example, five or smaller), that is, when the sheet stack Sa is light. When the sheet stack Sa is light in this way, the leading edge regulating member 1 is lowered to a position where the staple position of the sheet stack and the position of the leading edge of the abut plate 8 are substantially flush with each other. To be more specific, when the sheet stack Sa is light, the leading edge regulating member 1 is moved to a position where the position of the leading edge of the abut plate 8 and the staple position which is the desired fold position are flush with each other.

After the leading edge regulating member 1 is moved to such the position, the sheet stack Sa is set at a level where the staple position is flush with the position of the leading edge of the abut plate 8, and the sheet stack Sa is abutted against the abut plate 8. This can allow the sheet stack Sa the self weight of which is light and which has less body to be introduced to the paired folding rollers 3 with its lower edge away from the leading edge regulating member 1, in other words, with its lower edge lifted, while the height of the staple position is maintained, as illustrated in FIG. 4B.

Figure 5B:
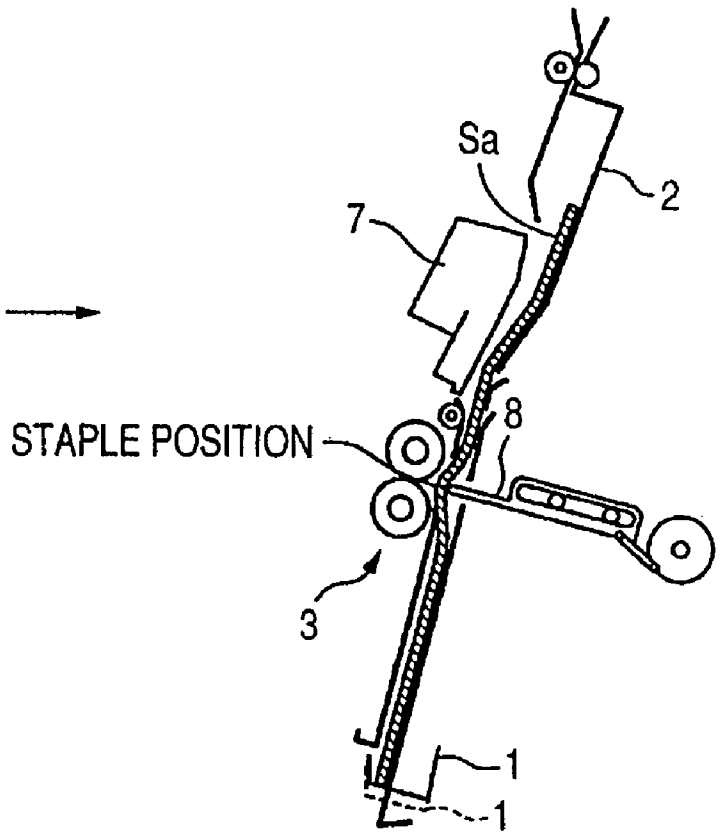
FIGS. 5A and 5B illustrate operation of folding a heavy sheet stack of the finisher.
Figure 5A:
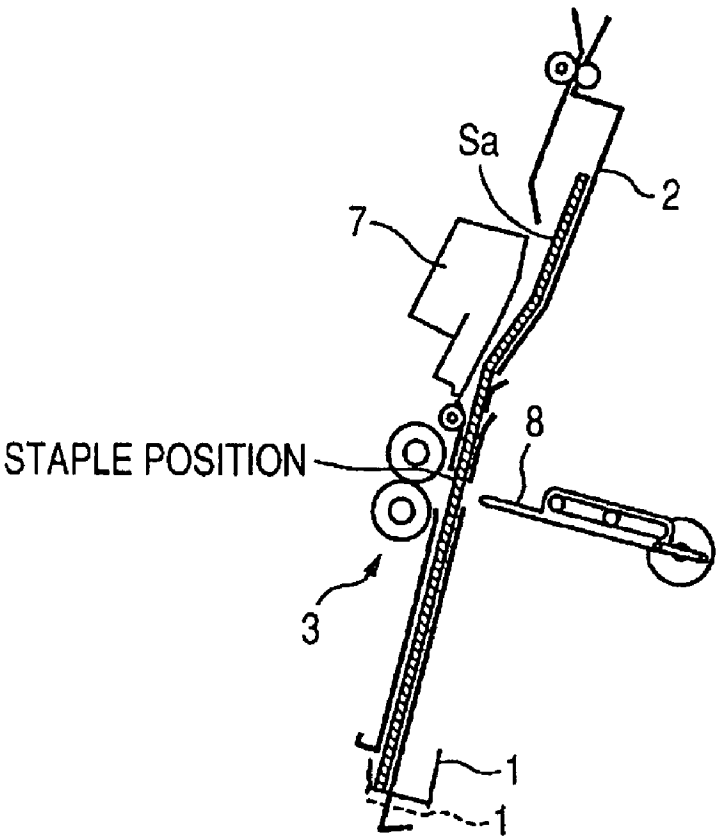

On the other hand, FIG. 5A illustrates a fold set position of the sheet stack Sa when its sheets are of ordinary thickness (for example, 80 g/m$^2$ paper) and the number of the sheets in the stack is large (for example, fifteen or larger), that is, when the sheet stack Sa is so heavy that, even though it is abutted against the abut plate 8, its lower edge can not be lifted.

When the sheet stack Sa is heavy in this way, the leading edge regulating member 1 is moved to a position where the staple position is higher than the position of the leading edge of the abut plate 8, that is, to a position higher than the position of the leading edge regulating member 1 in the case illustrated in FIG. 4. In other words, when the sheet stack Sa is heavy, the leading edge regulating member 1 is moved to a position where the staple position is higher by a predetermined amount than the position of the leading edge of the abut plate 8.

The difference between the height of the staple position and the height of the position of the leading edge of the abut plate 8 corresponds to the amount of misalignment according to the weight of the sheet stack Sa between the position where the sheet stack Sa is abutted against the abut plate 8 and the fold position where the sheet stack Sa is folded by the paired folding rollers 3. The finisher 500 is structured such that the sheet stack Sa is abutted against the abut plate 8 with a misalignment from the desired fold position by the amount of misalignment obtained based on the weight of the sheet stack Sa as an example of sheet stack information between the position where the sheet stack Sa is first abutted against the abut plate 8 and the desired fold position where the sheet stack Sa is folded by the paired folding rollers 3. The leading edge regulating member 1 is moved in this way.

In this embodiment, the amount of misalignment is found by experiments or the like and stored in a memory in advance. The leading edge regulating member 1 is moved so that the sheet stack Sa is abutted against the abut plate 8 with a misalignment from the desired fold position by the amount of misalignment stored in the memory based on the sheet stack information.

When the leading edge regulating member 1 is moved to such a position, the sheet stack Sa is set at a position where the staple position is higher by a predetermined amount than the position of the leading edge of the abut plate 8. As a result, the position of the sheet stack Sa abutted against the abut plate 8 is lower than the staple position of the sheet stack Sa.

When the abutting operation by the abut plate 8 is started with the sheet stack Sa set at the position, the abutted position of the sheet stack Sa against the abut plate 8 at an early stage is lower than the staple position. However, as the abutting operation progresses, due to the self weight of the sheet stack Sa, the leading edge of the abut plate 8 slides on the surface of the sheet to approach the staple position. When the sheet stack Sa enters the nip between the paired folding rollers 3, the abutted position becomes the staple position.

In this way, when the self weight of the sheet stack Sa is heavy, the leading edge regulating member 1 is positioned such that the abutting position of the abut plate 8 is lower than the staple position, and the sheet stack Sa can not go up when it is abutted against the abut plate 8 into a V shape as illustrated in FIG. 5B. Therefore, even if the lower edge of the sheet stack Sa is in contact with the leading edge regulating member 1, the staple position is introduced to the nip between the paired folding rollers 3 when the sheet stack Sa is folded.

When the number of the sheets in the sheet stack is determined by document reading or the like and the number is a predetermined value or larger, the height of the leading edge regulating member 1 in abutting and folding is controlled to be raised by a predetermined amount. This can eliminate the misalignment of the fold position.

It is to be noted that, although FIGS. 4 and 5 illustrate difference in the stop position of the leading edge regulating member 1 depending on the number of sheets in the sheet stack, the same situation occurs not only depending on the difference in the number of sheets but also depending on the difference in thickness or size of the sheets and on the surface state of the sheets in proximity to the abutted position.

For example, even when the number of sheets in the sheet stack is small, if a sheet of 250 g/m$^2$ or larger is folded, similarly to the case where a large number of sheets are folded, the lower edge of the sheet stack Sa may not go up in the abutting. Therefore, when a thick paper mode where thick paper is used is set, by controlling the height of the leading edge regulating member 1 in abutting and folding to be raised by a predetermined amount, the misalignment of the fold position can be eliminated.

Also, even when the number of sheets in the sheet stack is small, if smoothly coated paper is folded, the lower edge of the sheet stack Sa may not go up in the abutting similarly to the case where a large number of sheets are folded. Therefore, when a coated paper mode where coated paper is used is set, by controlling the height of the leading edge regulating member 1 in abutting and folding to be raised by a predetermined amount, the misalignment of the fold position can be eliminated.

In other words, the position of the leading edge regulating member 1 is controlled according to the kind of sheets. To be more specific, the position of the leading edge regulating member 1 is controlled according to the kind of sheets so that the sheet stack Sa is abutted against the abut plate 8 being misaligned with the fold position by the amount of misalignment between the position where the sheet stack Sa is first abutted against the abut plate 8 and the fold position where the sheet stack Sa is folded by the paired folding rollers 3.

Further, even when the same thick paper is used or the same large number of sheets are used, if the size of the sheets is different, set amount of misalignment of the leading edge regulating member 1 from the ordinary position differs. If the size of the sheets is small, the position of the leading edge regulating member 1 is positioned so that the staple position is substantially at the same height with the position of the leading edge of the abut plate 8. If the size of the sheet is large, the height of the leading edge regulating member 1 in abutting and folding is controlled to be raised by a predetermined amount.

When the portion of the sheet which is abutted against the abut plate 8 has a color image or the like formed thereon, the same situation occurs since the sheet tends to slip off the leading edge of the abut plate, and thus, the same control is effective when a color mode is selected.

When the portion of the sheet which is abutted against the abut plate 8 has a monochrome image formed thereon, the leading edge regulating member 1 is set at a position where the staple position is substantially at the same height with the position of the leading edge of the abut plate 8. When the portion of the sheet which is abutted against the abut plate 8 has a color image formed thereon, the height of the leading edge regulating member 1 in abutting and folding is controlled to be raised by a predetermined amount. It is to be noted that, in this case, the image forming portion 1003 recognizes whether the center portion of the sheet has an image thereon or not and the result is fed back to the finisher 500, thereby alleviating the misalignment of the fold position.

As described above, in this embodiment, the position of the leading edge regulating member 1 is controlled based on sheet stack information such as the number of sheets in the sheet stack, the kind of sheets in the sheet stack, the size of the sheet stack, and an image formed on the sheet. The position of the leading edge regulating member 1 is a position with a misalignment from the fold position which corresponds to the amount of misalignment between the position where the sheet stack Sa is first abutted against the abut plate 8 and the fold position where the sheet stack is folded by the paired folding rollers 3. The amount of misalignment is an amount based on the sheet stack information.

In the above embodiment, the leading edge regulating member 1 is moved to, for example, such a position that the position of the leading edge of the abut plate 8 is lower than the staple position by a predetermined amount when the number of sheets in the sheet stack is a predetermined number or larger.

However, the position of the leading edge regulating member 1 may be controlled so that the difference in height between the position of the leading edge of the abut plate 8 and the staple position becomes larger as the number of sheets in the sheet stack increases. In this case, also, the difference in height between the position of the leading edge of the abut plate 8 and the staple position allows for the amount of misalignment between the position where the sheet stack Sa is first abutted against the abut plate 8 and the fold position where the sheet stack is folded by the paired folding rollers 3.

Figure 6A:
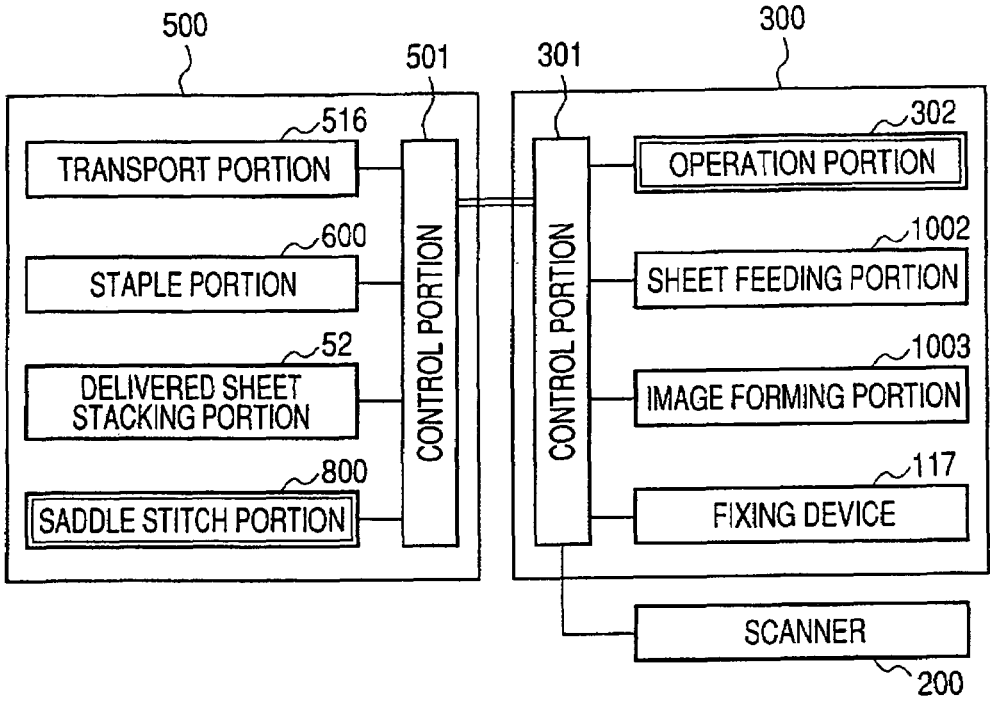
FIGS. 6A and 6B are system block diagrams illustrating a system of a copying machine body of a copying machine as the image forming system and a system of the finisher.
Figure 6B:
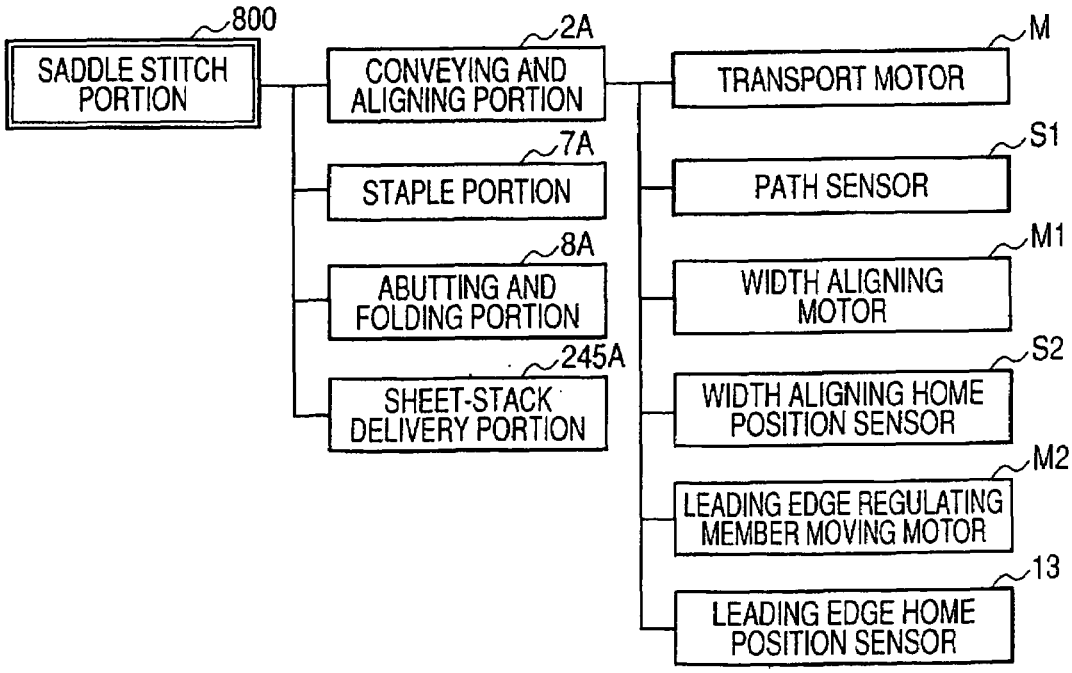

FIGS. 6A and 6B are system block diagrams illustrating a system of the copying machine body 300 and a system of the finisher 500 which conduct the control described above.

In FIG. 6A, a control portion 301 is provided in the copying machine body 300 for controlling the whole image forming operation of the copying machine body 300. An operating portion 302, the sheet feeding portion 1002, the image forming portion 1003, the fixing device 117, and the scanner 200 are connected to the control portion 301.

A control portion 501 is provided in the finisher 500 for controlling the whole sheet processing operation of the finisher 500. The control portion 301 on the side of the copying machine body is connected to the control portion 501. The control portion 501 is connected to a transport portion 516 for transporting a sheet by driving the buffer roller 513, a delivered sheet stacking portion 52 for delivering and stacking a sheet by driving the paired delivery rollers 519, the staple portion 600, and the saddle stitch portion 800.

As illustrated in FIG. 6B, the saddle stitch portion 800 includes a transporting and aligning portion 2A for transporting a sheet to the intermediate stacking tray 2 and for aligning the transported sheet, the staple portion 7A, and an abutting and folding portion 8A which includes the paired folding rollers 3 and the abut plate 8. The saddle stitch portion 800 also includes a sheet-stack delivery portion 245A for delivering to the delivery tray 246 the sheet stack Sa folded by driving the paper delivery rollers 245.

It is to be noted that the transporting and aligning portion 2A includes a transport motor M for transporting a sheet to the intermediate stacking tray 2 and a path sensor S1 for detecting that a sheet has been transported to the intermediate stacking tray 2. The transporting and aligning portion 2A also includes a width aligning motor M1 for moving in a width direction a width aligning member (not shown) for aligning a sheet stack in the width direction before stapling operation, and a width aligning home position sensor S2 for controlling the position of the width aligning member (not shown). Further, the transporting and aligning portion 2A includes a leading edge regulating member moving motor M2 as the drive means 12 described above and the leading edge home position sensor 13.

When saddle stitch bookbinding is conducted with this block structure, first, a user selects a bookbinding mode with the operating portion 302 provided in the copying machine body 300. After that, the document size, the sheet size, the kind of the sheet, whether saddle stitch is to be conducted or not, the number of copies, and the like are inputted. Then, an image is read by the scanner 200. The image is formed on the sheet by the image forming portion 1003, and the sheet having the image formed thereon is delivered from the copying machine body 300. The control portion 301 on the side of the copying machine body urges the control portion 501 on the side of the finisher to transport to the saddle stitch portion 800 the sheet delivered from the copying machine body 300.

When staple information is inputted from the operating portion 302 through the control portion 301 on the side of the copying machine body, the control portion 501 on the side of the finisher for moving the position of the leading edge regulating member 1 first drives the leading edge regulating member moving motor M2. This moves the position of the leading edge regulating member 1 to a predetermined height from the home position in preparation for the stapling operation. To be more specific, the control portion 501 controls the relative position between the sheet stack support member and the abut plate so that the position where the sheet stack is abutted against the leading edge of the abut plate with respect to the fold position is varied based on the sheet stack information for the purpose of folding the sheet stack at the desired fold position by the paired folding rollers.

The position of the leading edge regulating member 1 here is the position based on the sheet stack information. The sheet stack information is information obtained by an input from a user through the operating portion 302, the number of the sheets in the sheet stack determined through document reading, print job sent from a personal computer, or the like.

After the sheet stack is aligned and stapled, the control portion 501 lowers the leading edge regulating member 1 by the leading edge regulating member moving motor M2 and makes the leading edge regulating member 1 wait at an abutting and folding position, based on the sheet stack information from the operating portion 302 such as the sheet size and the kind of the sheet. The smaller the amount of lowering of the leading edge regulating member 1 after the sheet stack is aligned and stapled is, the higher the sheet stack is positioned. Therefore, if the amount of lowering of the leading edge regulating member 1 is getting smaller after the sheet stack is aligned and stapled is, the position is getting lower where the sheet stack is first abutted against the abut plate 8 in the sheet stack.

As described above, when the determined number of sheets to be saddle stitched (i.e., the number of sheets in the sheet stack) is, for example, fifteen or more, the control portion 501 controls the leading edge regulating member moving motor M2 so that the amount of lowering of the leading edge regulating member 1 is smaller by a predetermined amount than that in a case where the number is less than fifteen. When the number is less than fifteen, the control portion 501 controls the leading edge regulating member moving motor M2 so that the staple position is the position where the sheet stack is first abutted against the leading edge of the abut plate 8.

When the thick paper mode is set by the operating portion 302, the control portion 501 may control the leading edge regulating member moving motor M2 so that the amount of lowering of the leading edge regulating member 1 is smaller by a predetermined amount than that in a case where a thin paper mode is selected. In the thin paper mode when the sheet of the sheet stack is thin, the control portion 501 controls the leading edge regulating member moving motor M2 so that the staple position is the position where the sheet stack is first abutted against the leading edge of the abut plate 8.

When a large size is set as the size of the sheet stack by the operating portion 302, the control portion 501 may control the leading edge regulating member moving motor M2 so that the amount of lowering of the leading edge regulating member 1 is smaller by a predetermined amount than that in a case where a small size is set. In this case, in a small mode when the size of the sheet of the sheet stack is small, the control portion 501 controls the leading edge regulating member moving motor M2 so that the staple position is the position where the sheet stack is first abutted against the leading edge of the abut plate 8.

When the document to be read is a color document and color print is designated, after the image forming portion 1003 recognizes that the center portion (i.e., the portion to be folded) of the sheet has an image formed thereon, the control portion 501 controls the leading edge regulating member moving motor M2 so that the amount of lowering of the leading edge regulating member 1 is smaller by a predetermined amount than that in a case where the center portion of the sheet does not have an image formed thereon. It is to be noted that whether the center portion of the sheet has an image formed thereon or not is inputted from the control portion 301 on the side of the body to the control portion 501 on the side of the finisher.

It is to be noted that the predetermined amounts of lowering described above have been obtained by experiments or the like and are stored in a memory portion provided in the control portion 501. Although, as the sheet stack information, the number of sheets in the sheet stack, the thickness of sheets in the sheet stack, the size of sheets in the sheet stack, and whether the portion of the sheet in the sheet stack where the sheet is abutted against the abut plate has an image formed thereon or not are exemplified and described, the control portion 301 may be structured to control the position of the leading edge regulating member 1 based on information which is a combination of these information.

In this way, the leading edge regulating member 1 is selectively moved so that the position in the sheet stack Sa where the sheet stack Sa is abutted against the abut plate 8 is the staple position of the sheet stack Sa or a position off the staple position (in this case, a position lower than the staple position). Therefore, when the sheet stack Sa is folded, the abutted position can be the staple position. This can eliminate the misalignment of the fold position due to different number of the sheets or different kinds of the sheets and can make it possible to bind a sheet stack into a book of satisfactory appearance.

It is to be noted that, since the position of the leading edge regulating member 1 can vary depending on the size, it is not necessary to provide an additional mechanism for conducting the above-mentioned control.

As described in the above description, when the sheet stack Sa is too heavy to raise in folding, the position of the leading edge regulating member 1 is set to be higher than in an ordinary case.

Figure 7B:
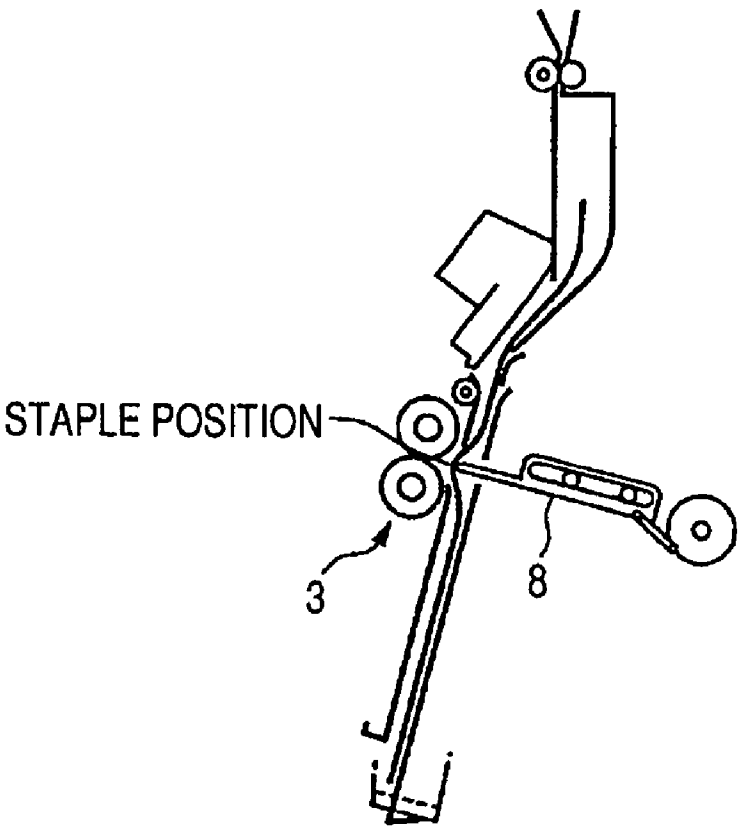
FIGS. 7A and 7B illustrate operation of folding a sheet stack caught on an upper portion of the finisher.
Figure 7A:
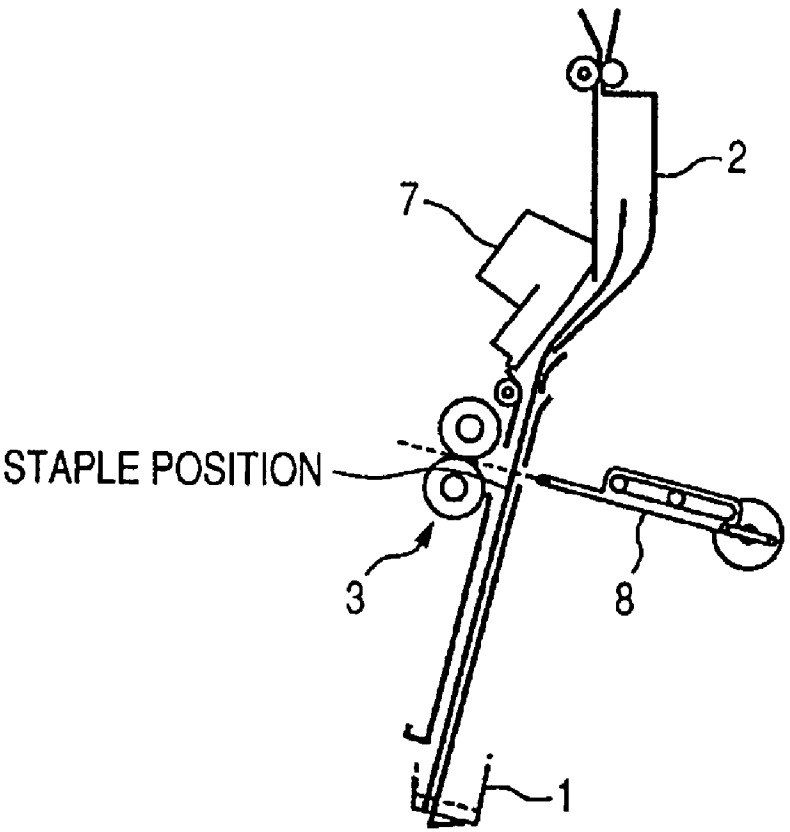
Figure 8A:
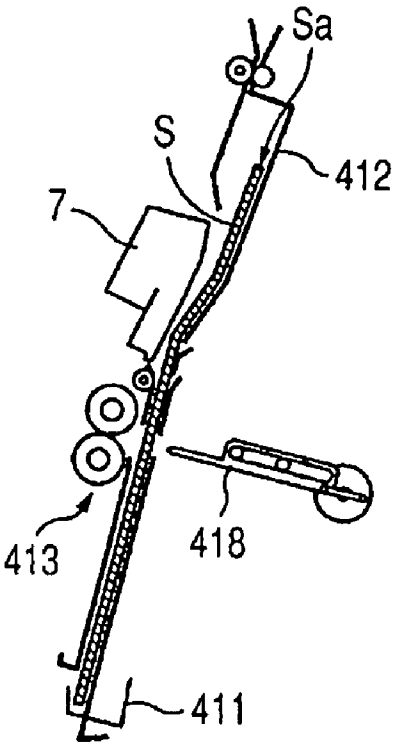
FIGS. 8A, 8B, 8C and 8D illustrate a mechanism of a misaligned fold position.
Figure 8B:
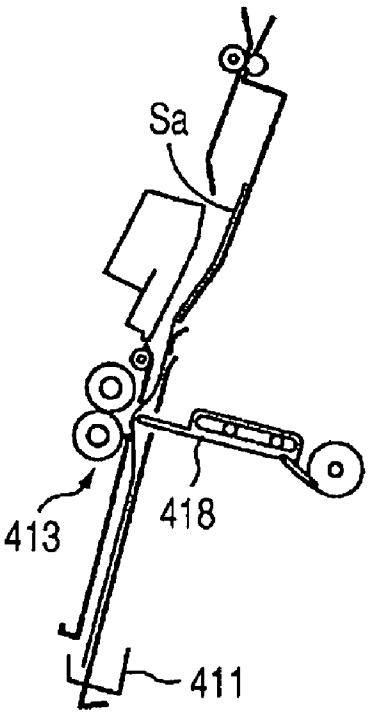
Figure 8C:
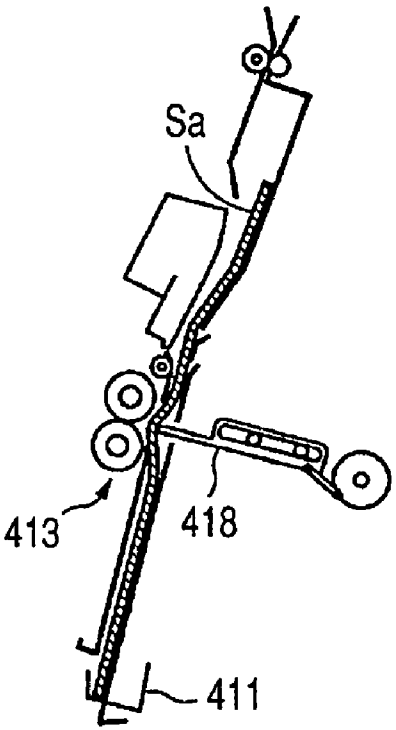
Figure 8D:
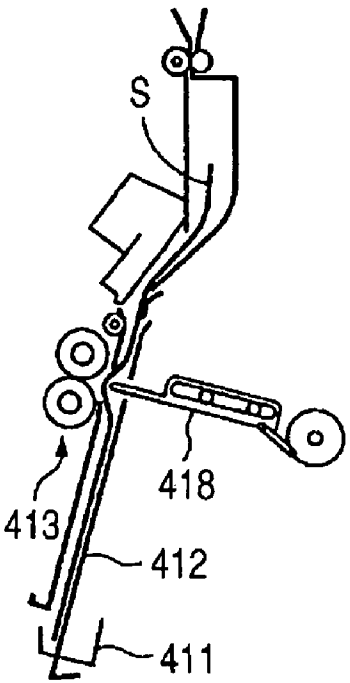
Figure 9:
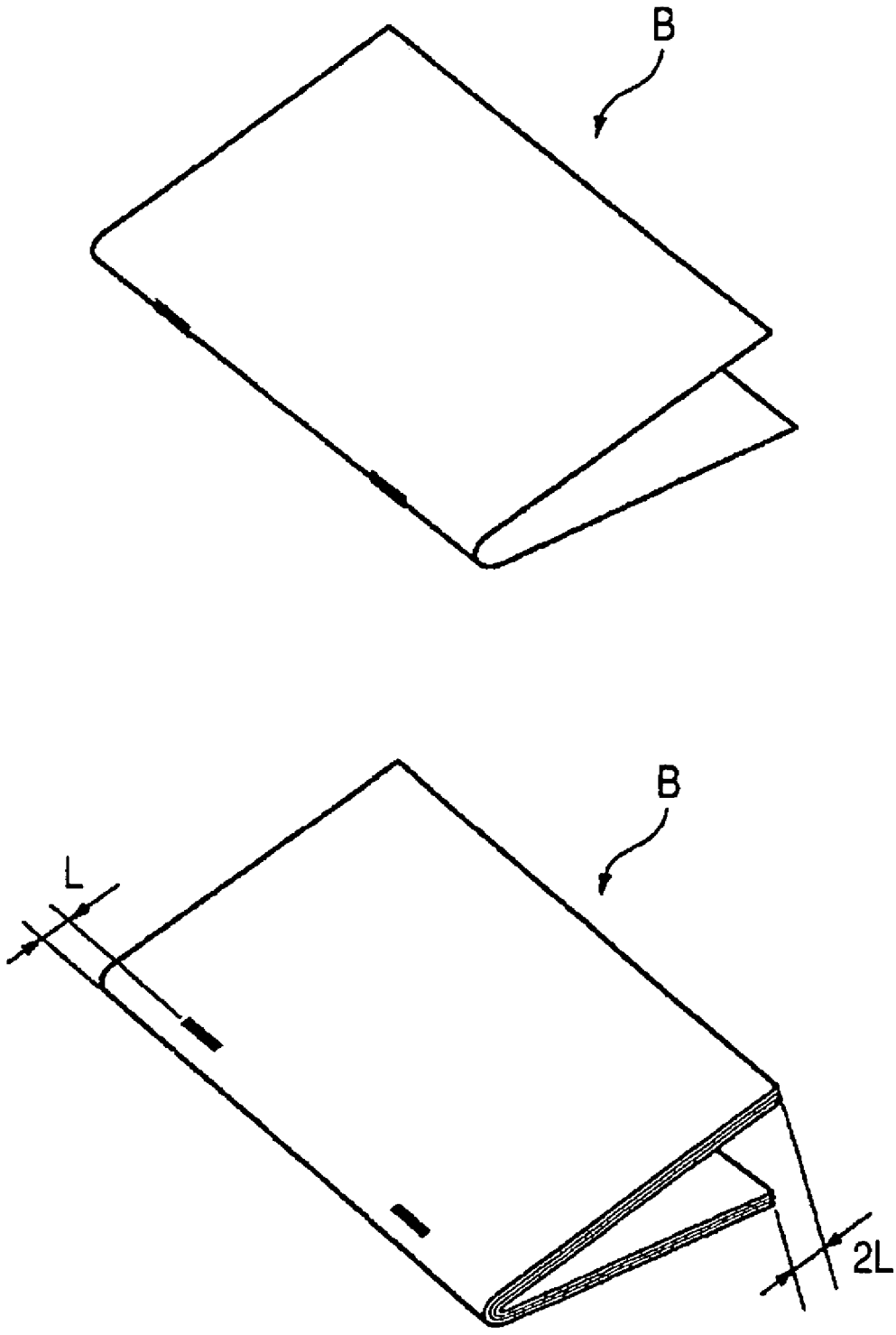
FIG. 9 illustrates a state of a brochure with the misaligned fold position.

However, as illustrated in FIG. 7, for example, sometimes a path above the fold position of the intermediate stacking tray 2 is rounded for the sake of convenience in arranging the finisher 500. If thick paper is set in such a path, when the sheet is abutted against the abut plate 8, due to transportation resistance above the abut plate 8, sometimes the sheet stack is caught on that portion and the sheet stack cannot go down.

In such a case, the position of the leading edge regulating member 1 in abutting and folding is set to be lower than the ordinary position illustrated by a broken line and the control portion 501 conducts control so that the set position of the leading edge regulating member 1 is lowered than in an ordinary case. By this, when abutting operation by the abut plate 8 is started, although the abutted position at an early stage is higher than the staple position, as the abutting operation progresses, the lower edge of the sheet stack Sa is lifted and the leading edge of the abut plate approaches the staple position. When the sheet stack Sa enters the nip between the paired folding rollers 3, the abutted position is the staple position.

In this way, when the sheet stack Sa cannot be lowered, the abutted position can be the staple position in folding, by selectively moving the position of the leading edge regulating member 1 to a position off the staple position and higher than the staple position. This can eliminate the misalignment of the fold position and can make it possible to bind a sheet stack into a book of satisfactory appearance.

It is to be noted that an embodiment where the control portion for controlling the whole sheet processing operation of the finisher 500 is provided in the finisher 500. However, the control portion for controlling the operation of the finisher 500 may be provided in the copying machine body 300 as an image forming apparatus and the control portion provided in the copying machine body 300 may control the operation of the finisher 500.

Further, in the above embodiment, the position where the sheet stack is first abutted against the abut plate 8 is varied by raising or lowering the position of the leading edge regulating member 1 based on the sheet stack information. However, there may be an embodiment where a mechanism for vertically moving the abut plate 8 and the paired folding rollers 3 is provided and the position where the sheet stack is first abutted against the abut plate 8 is varied by raising or lowering the abut plate 8 and the paired folding rollers 3 based on the sheet stack information.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2005-252418 filed on Aug. 31, 2005, which is hereby incorporated by reference herein.

What is claimed is:

1. A sheet folding apparatus which folds a sheet stack, comprising:

a sheet stack support member which supports a sheet stack by being abutted against a lower edge of the sheet stack;

an abutting member whose leading edge abuts against the sheet stack to fold the sheet stack supported by the sheet stack support member;

paired folding rollers which fold the sheet stack abutted by the abutting member at a predetermined fold position; and a control portion which changes a position where the sheet stack is abutted against the leading edge of the abutting member to be changed based on a sheet stack information, wherein the sheet stack information includes an information on an image formed on a portion of the sheet which is abutted against the leading edge of the abutting member, and the control portion changes the position where the sheet stack is abutted against the leading edge of the abutting member according to the image formed on the portion of the sheet which is abutted against the leading edge of the abutting member.

2. A sheet folding apparatus according to claim 1, wherein the control portion controls so that the sheet stack support member is selectively moved based on the sheet stack information to a position where the sheet stack is supported so that the position where the sheet stack is abutted against the abutting member substantially coincides with the predetermined fold position of the sheet stack or to a position where the sheet stack is supported so that the position where the sheet stack is abutted against the abutting member is misaligned with the predetermined fold position.

3. A sheet folding apparatus according to claim 1, further comprising a stitching portion which stitches the sheet stack, wherein the predetermined fold position is a position where the sheet stack is stitched by the stitching portion.

4. A sheet folding apparatus according to claim 1, wherein the sheet stack support member supports a sheet stack in an upright state.

5. A sheet folding apparatus according to claim 1, wherein the information on the image formed on a portion of the sheet which is abutted against the abutting member, is whether it is a color image or a monochrome image, the control portion controls so that, when the portion of the sheet which is abutted against the abutting member has a color image, the position where the sheet stack is abutted against the abutting member is lower than that in a case of having a monochrome image.

6. A sheet folding apparatus according to claim 1, wherein the information on the image formed on a portion of the sheet which is abutted against the abutting member is whether an image is a color image, the control portion controls so that, when the portion of the sheet which is abutted against the abutting member has a color image, the position where the sheet stack is abutted against the abutting member is lower than that in a case of not having a color image.

7. A sheet folding apparatus which folds a sheet stack, comprising:

a sheet stack support member which supports a sheet stack by being abutted against a lower edge of the sheet stack;

an abutting member whose leading edge abuts against the sheet stack to fold the sheet stack supported by the sheet stack support member; and paired folding rollers which fold the sheet stack abutted by the abutting member at a predetermined fold position, wherein a position where the sheet stack is abutted against the leading edge of the abutting member with respect to the predetermined fold position is varied according to the image formed on the portion of the sheet which is abutted against the leading edge of the abutting member.

8. An image forming apparatus connected to a sheet processing apparatus, the sheet processing apparatus comprising:

a sheet stack support member which supports a sheet stack by being abutted against a lower edge of a sheet stack;

an abutting member whose leading edge abuts against the sheet stack to fold the sheet stack supported by the sheet stack support member; and paired folding rollers which fold the sheet stack abutted by the abutting member at the predetermined fold position, the image forming apparatus comprising:

an image forming portion which forms an image on a sheet; and a control portion which changes a position where the sheet stack is abutted against the leading edge of the abutting member based on a sheet stack information, wherein:

the sheet stack information includes information on an image formed on a portion of the sheet which is abutted against the leading edge of the abutting member; and the control portion changes the position where the sheet stack is abutted against the leading edge of the abutting member according to the image formed on the portion of the sheet which is abutted against the leading edge of the abutting member.

9. An image forming apparatus comprising:

an image forming portion which forms an image on a sheet; and a sheet processing apparatus which processes the sheets on which images have been formed by the image forming portion, the sheet processing apparatus comprising:

a sheet stack support member which supports a sheet stack by being abutted against a lower edge of a sheet stack;

an abutting member whose leading edge abuts against the sheet stack to fold the sheet stack supported by the sheet stack support member;

paired folding rollers which fold the sheet stack abutted by the abutting member at a predetermined fold position; and a control portion which changes a position where the sheet stack is abutted against the leading edge of the abutting member based on a sheet stack information, wherein the sheet stack information includes an information on an image formed on a portion of the sheet which is abutted against the leading edge of the abutting member, and the control portion changes the position where the sheet stack is abutted against the leading edge of the abutting member according to the image formed on the portion of the sheet which is abutted against the leading edge of the abutting member.

* * * * *